United States Patent [19]

Nishikawa

[11] Patent Number: 4,522,399

[45] Date of Patent: Jun. 11, 1985

[54] DEVICE FOR GENERATING IMPACT SOUND FOR SLOT MACHINE

[75] Inventor: Ikuo Nishikawa, Tochigi, Japan

[73] Assignee: Kabushiki Kaisha Universal, Tochigi, Japan

[21] Appl. No.: 645,525

[22] Filed: Aug. 29, 1984

Related U.S. Application Data

[63] Continuation of Ser. No. 518,939, Aug. 1, 1983, abandoned.

[30] Foreign Application Priority Data

Aug. 2, 1982 [JP] Japan ..... 57-116221[U]

[51] Int. Cl.[3] ..... A63F 5/04

[52] U.S. Cl. ..... 273/143 R

[58] Field of Search ..... 273/143, 138

[56] References Cited

U.S. PATENT DOCUMENTS

| | | | |
|---|---|---|---|
| 1,376,874 | 3/1921 | Hamel | 273/143 R |
| 3,913,922 | 10/1975 | Richards et al. | 273/143 R |
| 4,037,845 | 7/1977 | Hooker | 273/143 R X |
| 4,058,026 | 11/1977 | Simpson | 273/143 R UX |

*Primary Examiner*—Paul E. Shapiro

*Attorney, Agent, or Firm*—Young & Thompson

[57] ABSTRACT

A device for generating an impact sound for a slot machine is disclosed, which is constructed to intentionally produce an impact sound when reels start to be rotated by motors. An operating member is rotated in an interlocked relation to the rotation of a handle while storing restoring force in a spring. When the handle is turned to a predetermined extent, the motors are started to cause rotation of the reels. Substantially simultaneously with the start of rotation of the reels, the operating member is returned by the restoring force stored in the spring, and an impact force is generated with the collision of the returned operating member with a stopper.

6 Claims, 4 Drawing Figures

DEVICE FOR GENERATING IMPACT SOUND FOR SLOT MACHINE

This application is a continuation of application Ser. No. 518,939, filed Aug. 1, 1983, now abandoned.

BACKGROUND OF THE INVENTION

This invention relates to a prize-winning game slot machine of motor drive type and, more particularly, to a device for generating an impact sound at the time of the start of rotation of reels, the impact sound being similar to that generated at the time of the start of a slot machine of mechanical drive type.

Prize-winning game slot machines include those of the commonly termed mechanical drive type, in which reels are given a mechanical impact to cause their rotation. More specifically, when a handle provided on one side of the body of the slot machine is pulled toward the front to a predetermined extent, a restoring force is stored in each of springs biasing driving pawls provided for the respective reels. The driving pawls are then released to exert a kicking force on the reels to cause rotation thereof. Thus, at the time of the start of the game an impact sound of driving the reels is generated, and also vibration (i.e., a shock) is felt by the player through the handle. Such an impact at the time of the start of the slot machine has been recognized by the slot machine fans as providing a sense of game play peculiar to the slot machine.

Recently, however, electric components are extensively employed in slot machines, and those where the reels are motor-driven are in actual use. In this type, the reels are started by reel drive motors by pulling the handle to a predetermined extent. In this system, the handle is operated merely for closing an electric switch, and the reels are started smoothly and quietly, i.e., without generation of any shock and sound of the kind generated at the time of the start of the conventional slot machine where the reels are mechanically driven. As mentioned earlier, however, the shock and sound generated by slot machines of the mechanical drive type has traditionally been recognized as providing the sense of game play peculier to slot machines. Therefore, the start of the slot machine without generation of any shock or sound presents an unusual feel to the player who is accustomed to the peculier shock and sound.

OBJECT OF THE INVENTION

The primary object of the invention is to provide a slot machine, which is of the motor drive type but nevertheless produces an impact sound like that of a slot machine of the mechanical drive type at the time of the start of the reels by the motors.

Another object of the invention is to provide a slot machine, in which an impact force is transmitted to the handle simultaneously with the generation of the impact sound.

A further object of the invention is to provide a slot machine which can generate the impact sound with a simple construction.

SUMMARY OF THE INVENTION

The above and further objects, features and advantages of the invention are attained by a construction, in which a restoring force is stored in a return spring of an operating member by pulling the slot machine handle so that the operating member is quickly returned by the return spring when the handle being pulled reaches a certain position. The quickly returned operating member strikes a stopper, and the impact of this collision generates an impact sound and is also transmitted to the handle.

DETAILED DESCRIPTION OF THE INVENTION

Figure 1:
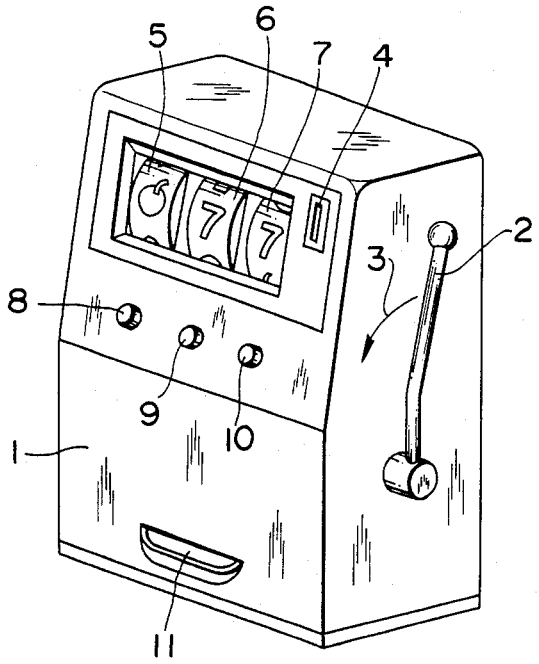
FIG. 1 is a perspective view showing a prize-winning game slot machine.

Referring now to FIG. 1, there is shown a prize-winning game slot machine comprising a machine body 1 with a handle 2 provided on one side. The handle 2 is operable in the direction of arrow 3. By inserting a coin or coins into a coin slot 4 and then pulling the handle 2, an impact sound to be described later is produced, while reels 5 to 7 are started. The reels 5 to 7 are each driven by a pulse motor (not shown). After the reels 5 to 7 are started in rotation, they can be stopped by depressing respective stop buttons 8 to 10. Points of the game are determined by the combination of symbol patterns of the reels 5 to 7 that are displayed when the reels are stopped, and coins corresponding in number to the number of points are paid out into a saucer 11.

Figure 2:
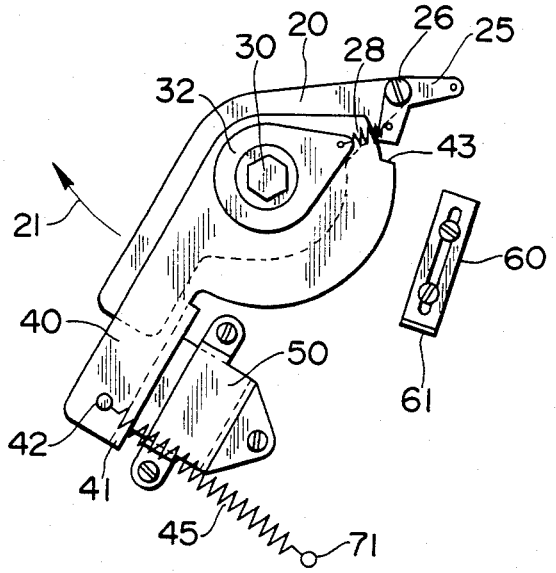
FIG. 2 is a front view showing an embodiment of the invention.
Figure 3:
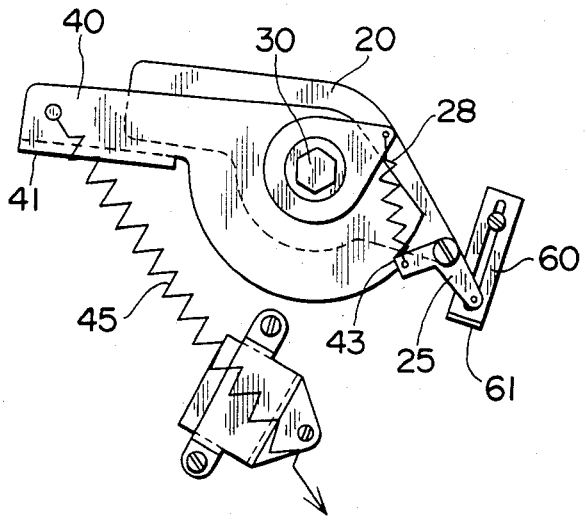
FIG. 3 is a front view of the same embodiment with an operating member charged in an interlocked relation to a handle.
Figure 4:
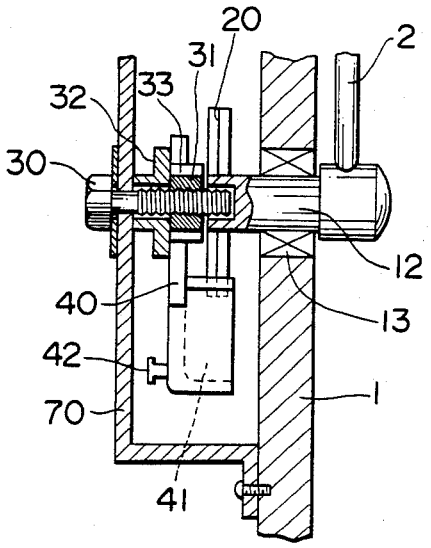
FIG. 4 is a fragmentary sectional view showing the same embodiment.

FIGS. 2 through 4 show an embodiment of the invention. In FIGS. 2 and 3, a base plate 70 shown in FIG. 4 is omitted to simplify the illustration. For the same purpose, a locking pawl 25, a releasing member 60 and a stopper 50 shown in FIG. 2 are omitted in FIG. 4.

The handle 2 is integral with a shaft 12, which is rotatably supported in the machine body 1 via a bearing 13. A driving member 20 is secured to the shaft 12. When the handle 2 is operated to start the reels, the driving member 21 is rotated in the direction of arrow 20 in FIG. 2. A bolt 30 penetrates the base plate 70. A support member 32 is clamped between the base plate 70 and a nut 31 screwed on the bolt 30. The bolt 30 is coaxial with the shaft 12. The locking pawl 25 is pivotally mounted on one end of the driving member 20 and biased by a spring 28 having one end attached to it and the other end attached to the support member 32. It is biased in the clockwise direction about its pivotal support point 26. An operating member 40 is rotatably mounted on the nut 31 via a collar 33. It has a locking shoulder 43, with which the locking pawl 25 can engage. It also has a lower projection 41 and an integral pin 42. A return spring 45 having a comparatively strong spring force has one end attached to the pin 42 and the other end attached to a support pin 71 projecting from the base plate 70. The operating member 40 is thus biased in the counterclockwise direction. A return stopper 50, which is struck by the returning operating member 40, is secured to the machine body 1. The releasing member 60 is also secured to the machine body 1, and it has a projection 61.

In operation, with the handle 2 operated by the player the driving member 20 is rotated in the direction of arrow 21 in FIG. 2. At this time, the locking pawl 25 is held engaged with the locking shoulder 43 of the operating member 40 by the spring force of the spring 28, so that the operating member 40 is rotated in unison with the handle 2 to store restoring force in the spring 45. This state is shown in FIG. 3. During this time, restoring force is also stored in the spring 28.

As the operation of the handle 2 is continued, one end of the locking pawl 25 pivoted to the operating member 20 eventually strikes the projection 61 of the releasing member 60. A slight further operation of the handle causes the locking pawl 25 to be rotated in the counterclockwise direction about its support point. As a result, the locking pawl 25 leaves the locking shoulder 43 of the operating member 40, whereupon it is quickly returned in the counterclockwise direction by the restoring force of the return spring 45. The returning motion of the operating member 40 is stopped by the collision of its lower projection 41 with the stopper 50. This collision produces an impact sound and vibrations. Simultaneously with this collision, a switch (not shown) interlocked with the handle is turned on, starting pulse motors (not shown) to cause rotation of the reels. The player thus can sense with the senses of sight, feel and hearing that the reels are started. By subsequently removing or reducing the operating force applied to the handle, the handle 2 is returned with the driving member 20 to the initial position shown in FIG. 2 by a spring (not shown) or the spring 28. At this time, the operating member 40 has already been returned to the initial position, so that the locking pawl 25 is returned by the spring force of the spring 28 to the initial position shown in FIG. 2 in frictional contact with the periphery of the operating member 40. The timing, with which the operating member 40 is returned, is adjustable by adjusting the position of the releasing member 60.

As has been described in the foregoing, according to the invention a sense of game play peculier to the conventional prize-winning game slot machine of the mechanical drive type can be obtained even with a slot machine, in which are reels are motor-driven. Besides, the impact sound and vibrations are generated due to the restoring force of the return spring for returning the operating member, so that they are substantially constant irrespective of the operating force applied to the handle for operation.

Furthermore, in the above embodiment the individual components are coaxially mounted on the handle shaft which is convenient in relation to other structures interlocked with the handle, for instance the reel drive mechanism, and particularly convenient for determining the timing of operations of the individual components, and also advantageous from the standpoint of efficient use of space and arrangement of the components. However, the above embodiment is by no means limitative. For example, the driving member and operating member may be made slidable. Also, the action of releasing the locking pawl to allow the return motion of the operating member may be brought about by electromagnetic means such as a solenoid in response to the closure of a switch caused upon reaching of a predetermined extent of operation of the handle.

What is claimed is:

1. In a slot machine of the type in which a display of a plurality of rotating juxtaposed reels is initiated by rotating a handle, the improvement comprising:

a first member movable in an interlocked relation to said handle;

a second member coupled to said first member and movable in unison therewith free from movement relative thereto during forward rotation of said handle;

means for disengaging said first and second members from each other substantially at the end of the full forward rotation of said handle;

a spring for biasing said second member in the direction opposite to the direction of movement of said first member;

said second member being mounted for rapid free return motion under the influence of said spring; and a third member for producing an impact sound when struck by said second member in the return motion thereof after disengagement from said first member.

2. The slot machine according to claim 1, wherein said first member is secured to the shaft of said handle.

3. The slot machine according to claim 2, wherein said first member carries a pivotally mounted locking pawl.

4. The slot machine according to claim 3, wherein said locking pawl can be engaged with and disengaged from said second member.

5. The slot machine according to claim 4, wherein said disengaging means is disposed in a range of movement of said locking pawl, a pawl portion of said locking pawl being disengaged from a locking section of said second member when the free end of said locking pawl is received by said disengaging means.

6. The slot machine according to claim 5, wherein said second member is freely rotatably mounted on a shaft coupled to said first member and is restrained in its movement of rotating only by said pawl and said third member.

* * * * *